US008505225B1

(12) United States Patent
Degener

(10) Patent No.: US 8,505,225 B1
(45) Date of Patent: Aug. 13, 2013

(54) FIREARM TRIGGER ASSEMBLY

(76) Inventor: Mark L. Degener, Rockford, IL (US)

( * ) Notice: Subject to any disclaimer, the term of this patent is extended or adjusted under 35 U.S.C. 154(b) by 0 days.

(21) Appl. No.: 13/433,988

(22) Filed: Mar. 29, 2012

(51) Int. Cl.
*F41A 19/10* (2006.01)

(52) U.S. Cl.
USPC ..... 42/69.01

(58) Field of Classification Search
USPC ..... 42/69.01–69.03, 65, 41, 42.01–42.03, 42/DIG. 1; 89/27.11, 27.3, 136; 124/31, 124/38
See application file for complete search history.

(56) References Cited

U.S. PATENT DOCUMENTS

| | | | | | |
|---|---|---|---|---|---|
| 53,306 | A | * | 3/1866 | Kirk | 42/69.01 |
| 620,796 | A | * | 3/1899 | Lindberg et al. | 42/69.01 |
| 929,311 | A | * | 7/1909 | Kilgore | 42/57 |
| 1,909,425 | A | * | 5/1933 | Reid | 42/69.01 |
| 2,564,960 | A | * | 8/1951 | Cubbage | 42/69.02 |
| 2,589,227 | A | * | 3/1952 | Colley | 42/69.01 |
| 2,607,148 | A | * | 8/1952 | Simpson | 42/69.01 |
| 3,091,878 | A | * | 6/1963 | Savioli | 42/69.01 |
| 4,058,924 | A | * | 11/1977 | Mullner | 42/69.01 |
| 4,499,683 | A | * | 2/1985 | Savioli | 42/69.01 |
| 4,514,923 | A | * | 5/1985 | Teel | 42/69.01 |
| 4,691,461 | A | * | 9/1987 | Behlert | 42/69.01 |
| 4,908,970 | A | * | 3/1990 | Bell | 42/69.02 |

FOREIGN PATENT DOCUMENTS

FR 2619440 A1 * 2/1989

* cited by examiner

*Primary Examiner* — Bret Hayes
*Assistant Examiner* — Reginald Tillman, Jr.
(74) *Attorney, Agent, or Firm* — Reinhart Boerner Van Deuren P.C.

(57) ABSTRACT

A firearm trigger assembly is provided. The firearm trigger assembly includes first and second trigger elements having independent pivot points. The first and second trigger elements can also each incorporate rolling contact elements to minimize frictional contact between one another and the remainder of a firing mechanism incorporating the trigger assembly.

9 Claims, 5 Drawing Sheets

FIREARM TRIGGER ASSEMBLY

FIELD OF THE INVENTION

This invention generally relates to firearms, and more particularly to firing mechanisms of firearms.

BACKGROUND OF THE INVENTION

Target shooting enthusiasts constantly strive for ways to improve their precision and accuracy with regard to placing their shots on target. These shooters often undergo extensive training and hours of practice all in an effort to enhance their own skill with regard to basic marksmanship fundamentals. Despite such training, shooters are ultimately limited by the physical parameters of the firearms they are employing, as well as the ammunition fired therefrom. These parameters can include barrel weight and machining characteristics, firearm balance, ammunition ballistic performance, trigger mechanics, etc.

Of these parameters, it has been shown that trigger mechanics play an important, if not the most important, role in shooter precision and accuracy. Particularly, the amount of force (i.e. "trigger pull") required to actuate a trigger assembly of a firing mechanism is of utmost importance. Trigger pull is typically measured in pounds. Too much trigger pull can cause a shooter to press so hard upon a trigger that the shooter also exerts a torque on the firearm which pulls the firearm off target.

As such, there is a continuing need in the art for a trigger assembly with enhanced trigger sensitivity that will reduce trigger pull to improve accuracy.

The invention provides such a trigger mechanism. These and other advantages of the invention, as well as additional inventive features, will be apparent from the description of the invention provided herein.

BRIEF SUMMARY OF THE INVENTION

In one aspect, a firearm trigger assembly is provided. An embodiment of a firearm trigger assembly according to this aspect includes a first trigger element pivotably mounted at a first pivot point. A second trigger element is pivotably mounted at a second pivot point. The second pivot point is in spaced relation to the first pivot point. A portion of the first trigger element is received in a recess of the second trigger element such that rotation of the first trigger element about the first pivot point causes a rotation of the second trigger element about the second pivot point opposite the rotation of the first trigger element about the first pivot point.

In certain embodiments, a yoke and tongue arrangement is formed between the first and second trigger elements such that the second trigger element includes a yoke portion that defines the recess thereof. The first trigger element includes a tongue portion that is the portion received in the recess of the second trigger element. The recess defines an interior contact surface for contact with the first trigger element.

In certain embodiments, a first rolling contact element is rotationally mounted on the tongue portion and is positioned within the recess of the second trigger element. The first rolling contact element is in contact with the interior contact surface of the recess. A second rolling contact element is rotationally mounted on the second trigger element and is arranged to intermittently contact an actuation element of a firing mechanism incorporating the trigger assembly. In certain embodiments, the first and second rolling contact elements are roller bearings.

In certain embodiments, the first and second pivot points are in spaced relation such that the rotation of the first trigger elements about the first pivot point in a first rotational direction causes the second trigger element to rotate about the second pivot point in a second rotational direction opposite the first rotational direction.

In another aspect, a firearm trigger assembly is provided. An embodiment of the firearm trigger assembly according to this aspect includes a first trigger element including a first rolling contact element mounted thereon. The firearm trigger assembly also includes a second trigger element including a second rolling contact element mounted thereon. The first rolling contact element is in rolling contact with a contact surface of the second trigger element.

In certain embodiments, the second rolling contact element mounted on the second trigger element is arranged to intermittently contact an actuation element of a firing mechanism incorporating the trigger assembly. The first rolling contact element is received within a recess which defines the contact surface of the second trigger element. The first rolling contact element moves linearly within the recess relative to the contact surface upon rotation of the first trigger element about a first pivot point at the first trigger element is pivotably mounted at. The first rolling contact element also rotates about its center axis while moving linearly within the recess relative to the contact surface.

In certain embodiments, the first trigger element is pivotably mounted at a first pivot point and the second trigger element is pivotably mounted at a second pivot point separate from the first pivot point. The first and second pivot points are arranged such that rotation of the first trigger element about the first pivot point in a first rotational direction causes the second trigger element to rotate about the second pivot point in a second rotational direction opposite the first rotational direction.

In certain embodiments, the first trigger element defines at least one abutment surface, and the second trigger element defines at least one abutment surface. The at least one abutment surface of the first trigger element and the at least one abutment surface of the second trigger element are arranged to abut one another to limit relative motion of the first trigger element relative to the second trigger element.

In certain embodiments, the at least one abutment surface of the first trigger element includes first and second abutment surfaces. The at least one abutment surface of the second trigger element includes third and fourth abutment surfaces. The first and second abutment surfaces simultaneously contact the third and fourth abutment surfaces to limit relative motion of the first trigger element relative to the second trigger element.

In another aspect, a firearm is provided. An embodiment of a firearm according to this aspect includes a firing mechanism including an actuation element for firing a round of ammunition, the firing mechanism includes a trigger assembly that includes a first trigger element including a first rolling contact element. The trigger assembly also includes second trigger element including a second rolling contact element. The first rolling contact element is in rolling contact with a contact surface of the second trigger element. The second rolling contact element is an intermittent rolling contact with the actuation element of the firing mechanism.

In certain embodiments, the first trigger element is pivotably mounted at a first pivot point, and the second trigger element is pivotably mounted at a second pivot point separate from the first pivot point. The first and second pivot points are arranged such that rotation of the first trigger element about the first pivot point in a first rotational direction causes the second trigger element to rotate about the second pivot point in a second rotational direction opposite the first rotational direction.

In certain embodiments, during the first trigger element in the first rotational direction, the first rolling contact element rotates about its center axis and moves linearly within a recess of the second trigger element. Rotation of the second trigger element in the second rotational direction brings the second rolling contact element into rolling contact with a contact surface of the actuation element such that the second rolling contact element moves along the contact surface of the actuation element and simultaneously rotates about its center axis.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, FIGS. 1-9 illustrate an exemplary embodiment of a firing mechanism 20 employing an exemplary embodiment of a trigger assembly 22 according to the teachings of the present invention. Those skilled in the art will immediately recognize from the following that the trigger assembly 22 is not limited in its application to the firing mechanism 20 illustrated. Indeed, such illustration should recognize as an example and not a limitation.

Figure 1:
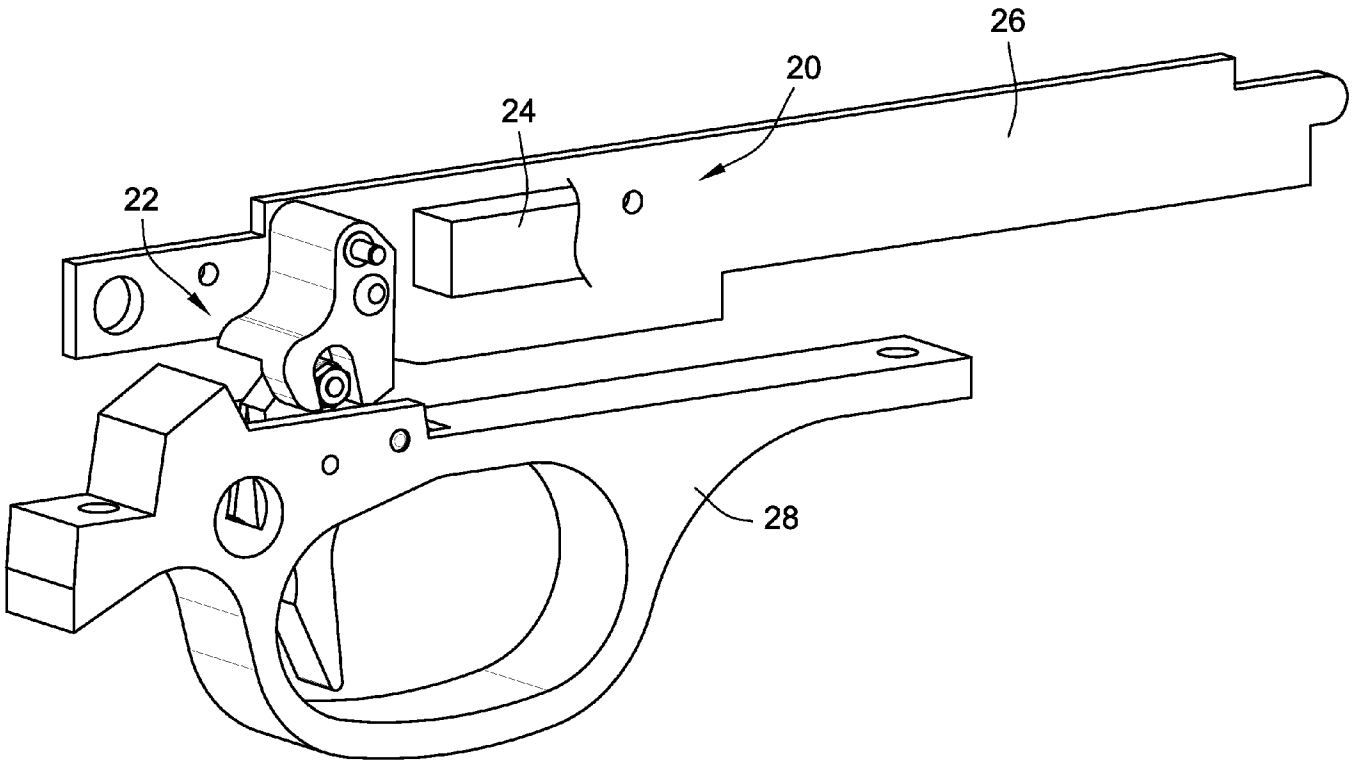
FIG. 1 is a perspective view of a firing mechanism in association with an embodiment of a trigger assembly according to the teachings of the present invention.

With specific reference to FIG. 1, a firing mechanism 20 is partially illustrated. The firing mechanism 20 includes a trigger assembly 22 according to the teachings of the present invention. As will be explained in greater detail in the following, the trigger assembly 22 advantageously and substantially reduces the amount of trigger pull via the use of rolling contact elements and multi-component design characteristics.

Firing mechanism 20 incorporates actuation element 24 which is schematically shown throughout the figures. Actuation element 24 represents a remainder of the firing mechanism 20 downstream from the trigger assembly 22 which is intermittently contacted by the trigger assembly 22 to ultimately fire the firearm incorporating the firing mechanism 20. Those skilled in the art will recognize that actuation element 24 can take on a variety of forms depending on the particular firearm that trigger assembly 22 is incorporated in. Actuation element 24 is mounted to side plate 26 of firing mechanism 20. Situated in proximity to the firing mechanism 20 is trigger guard 28. Trigger assembly 22 extends through trigger guard 28 and a portion thereof is accessible by an operator to fire a firearm incorporating firing mechanism 20. The specific shape and configuration of trigger guard 28 is merely exemplary and the same will take on a variety of forms depending on the particular firearm that trigger assembly 22 is incorporated in.

Figure 2:
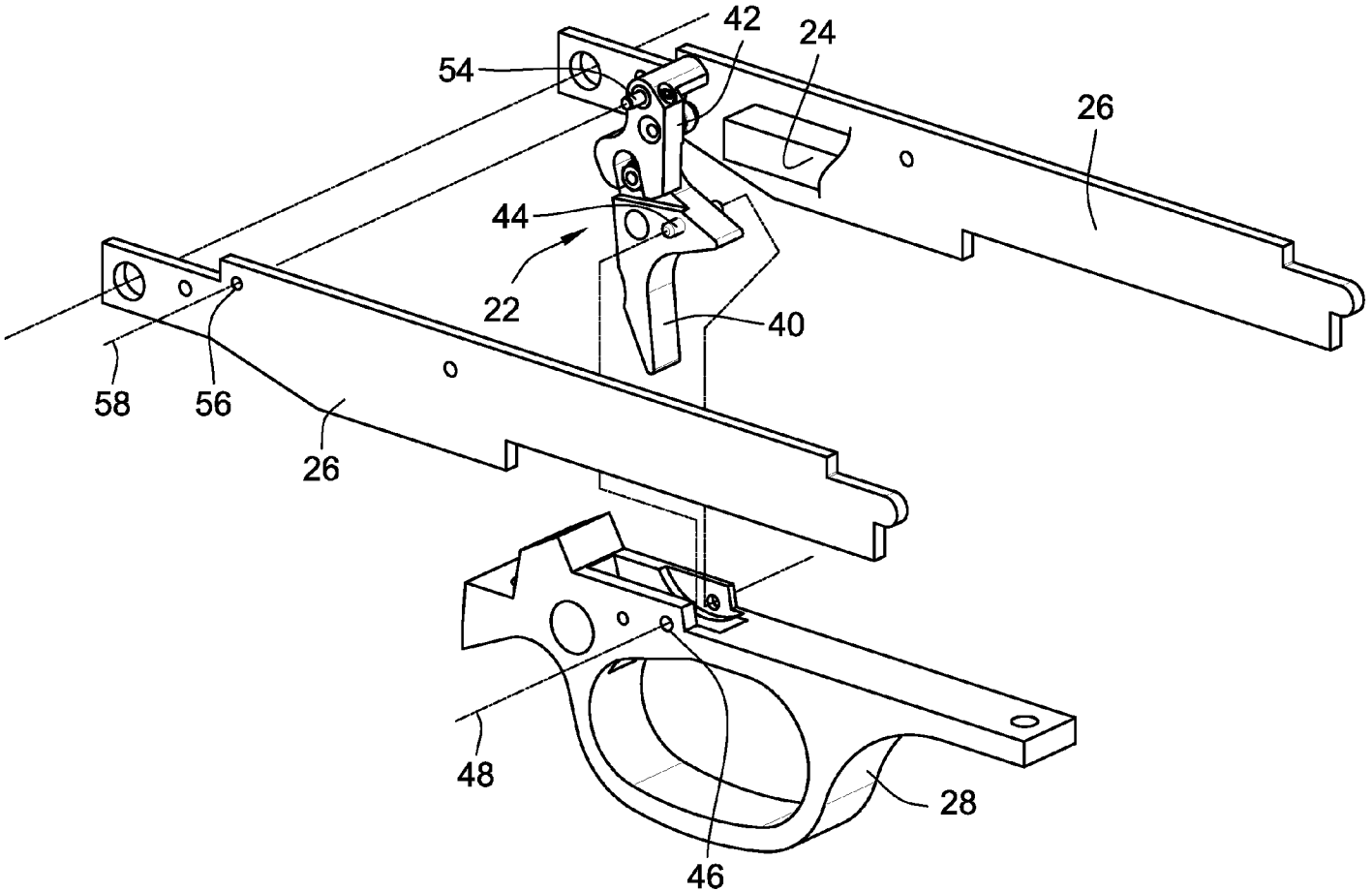
FIG. 2 is an exploded view of the firing mechanism of FIG. 1.

Turning now to FIG. 2, trigger assembly 22 includes first and second trigger elements 40, 42. First trigger element 40 is pivotably mounted to trigger guard 28. More specifically, pin 44 extends through first trigger element 40 and also through aperture 46 of trigger guard 48. As a result, first trigger element 40 is pivotable about axis 48 defined by aperture 46.

Second trigger element 42 is pivotably mounted to side plates 26. More specifically, pin 54 extend through second trigger element 42 and through aperture 56 of side plates 26. As a result, second trigger element 42 is pivotable about axis 58 defined by aperture 56.

Figure 3:
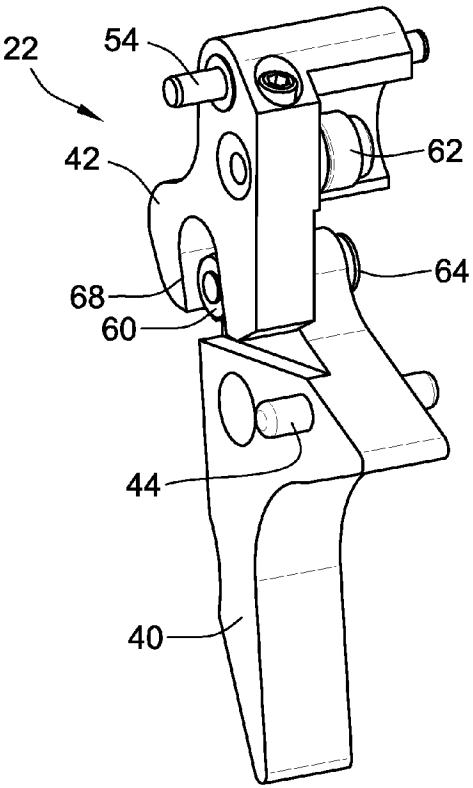
FIG. 3 is a perspective view of the trigger assembly of FIG. 1.

Turning now to FIG. 3, trigger assembly 22 is shown in a perspective view. First trigger element 40 incorporates a first rolling contact element 60, while second trigger element 42 incorporates a second rolling contact element 62. As will be described in greater detail below, first and second rolling contact elements 60, 62 substantially reduce the frictional contact of trigger assembly 22 to assist in providing the aforementioned reduction in trigger pull. First rolling contact element 60 is connected to first trigger element 42 by way of fastener 64. Similarly, second rolling contact element 62 is connected to second trigger element 42 by way of fastener 66. In the illustrated embodiment, fastener 64 is generally a nut and bolt configuration, while fastener 66 is generally a set screw configuration. First rolling contact element 60 extends into a recess 68 formed in second trigger element 42. As will be understood from the following, first rolling contact element 60 contacts an interior contact surface of recess 68 during actuation of trigger assembly 22. Those skilled in the art will recognize that such a contact between first and second trigger elements 40, 42 is substantially low friction.

Second rolling contact element 62 is generally exposed on second trigger element 42 for intermittent contact with actuation element 24 (See FIG. 1). As was the case with first rolling contact element 60, second rolling contact element 62 presents a rolling contact with actuation element 24 to thereby substantially reduce the frictional contact between these components. Rolling contact element 60, 62 can be embodied by rotatable pins, bearings, etc. Indeed, any element that is not rotationally fixed will adequately provide the advantages described herein.

Figure 4:
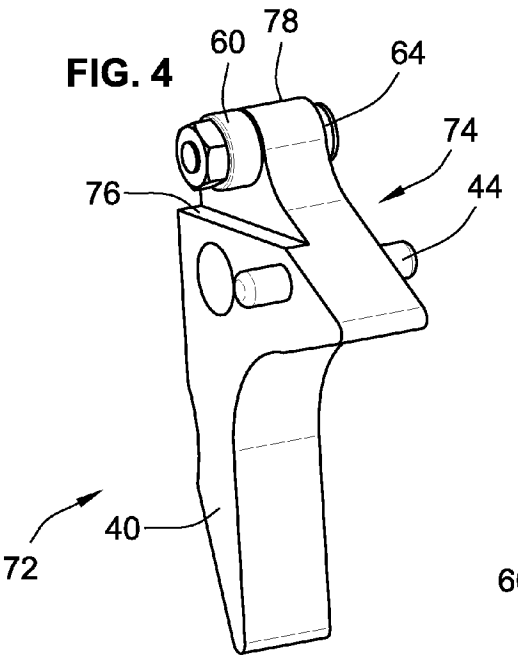
FIG. 4 is a perspective view of a first trigger element of the trigger assembly shown in FIG. 3.

Turning now to FIG. 4, first trigger element 42 includes trigger pad portion 72 and tongue portion 74 generally separated by a plane defined by first abutment surface 76. Tongue portion 74 includes second abutment surface 78 formed on a back side thereof relative to FIG. 4. As will be described in greater detail below, first and second abutment surfaces 76, 78 interact with abutment surfaces second trigger element 42 to limit the relative motion between first and second trigger elements 40, 42.

Figure 5:
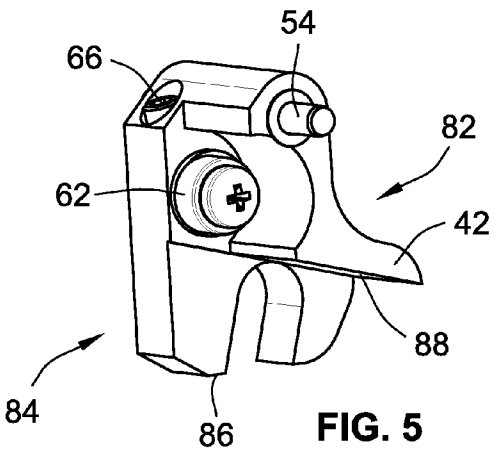
FIG. 5 is a perspective view of a section trigger element of the trigger assembly shown in FIG. 5.

With reference now to FIG. 5, second trigger element 42 includes contact portion 82 and yoke portion 84. Yoke portion 84 includes third abutment surface 86 formed at a distal end thereof as illustrated. Second trigger element 42 also includes fourth abutment surface 88 which defines a plane generally separates contact portion 82 from yoke portion 84.

Figure 6:
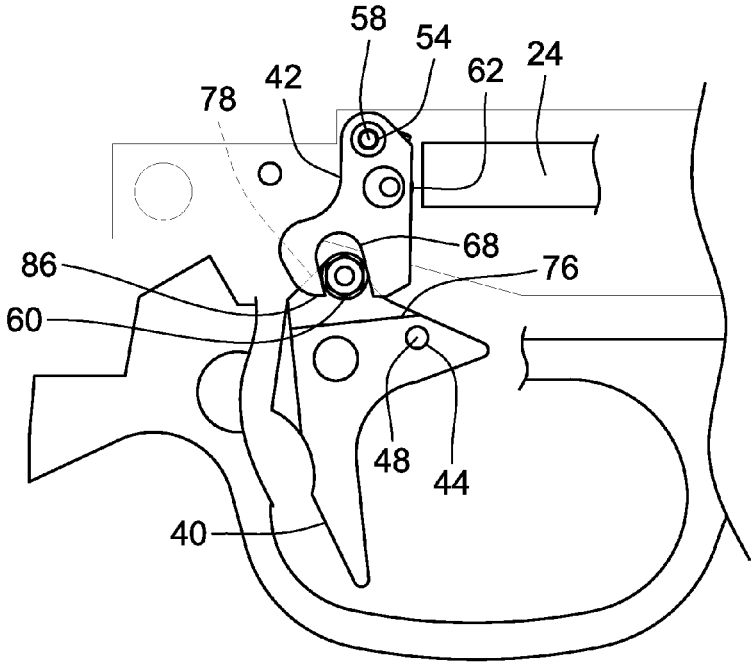
FIGS. 6-9 are side views of the trigger assembly of FIG. 1 during various stages of operation.
Figure 7:
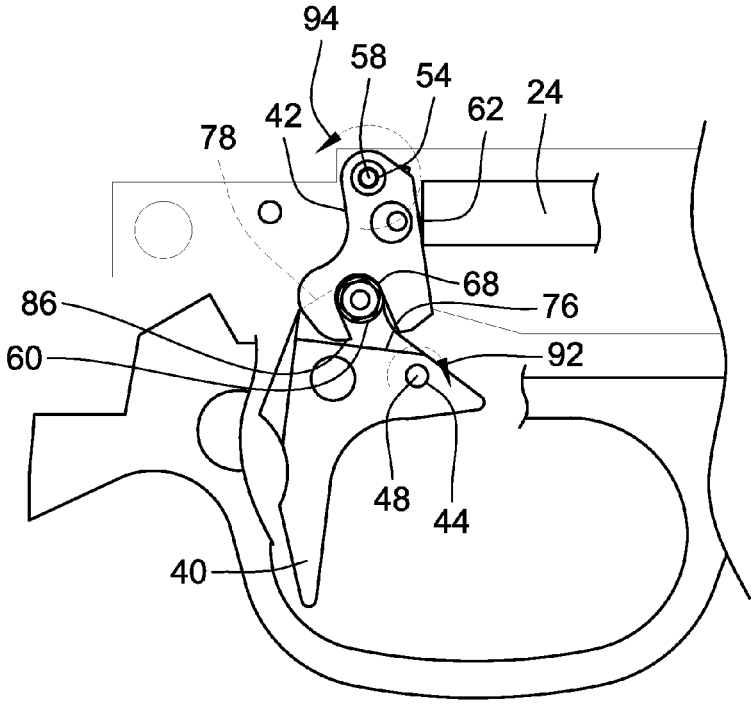

Having described the general structural attributes of one embodiment of the invention, the operation of the same will now be described with reference to FIGS. 6-9. With particular reference to FIG. 6, trigger assembly 22 is shown in its at rest position. First rolling contact element 60 is positioned within in recess 68 and in contact with the interior contact surface thereof. Second rolling contact element 62 remains out of contact with actuation element 24. With reference now to FIG. 7, as first trigger element 40 is depressed, causing the same to pivot about axis 48 in rotational direction 92, first rolling contact element 60 moves linearly within recess 68 while at the same time rotating about its own center axis thereby creating a substantially low friction engagement between first trigger element 40 and second trigger element 42. Rotation of first trigger element 40 about axis 48 in rotational direction 92 also causes second trigger element 42 to rotate about axis 58 in rotational direction 94 thereby moving second rolling contact element 62 towards actuation element 24.

Figure 8:
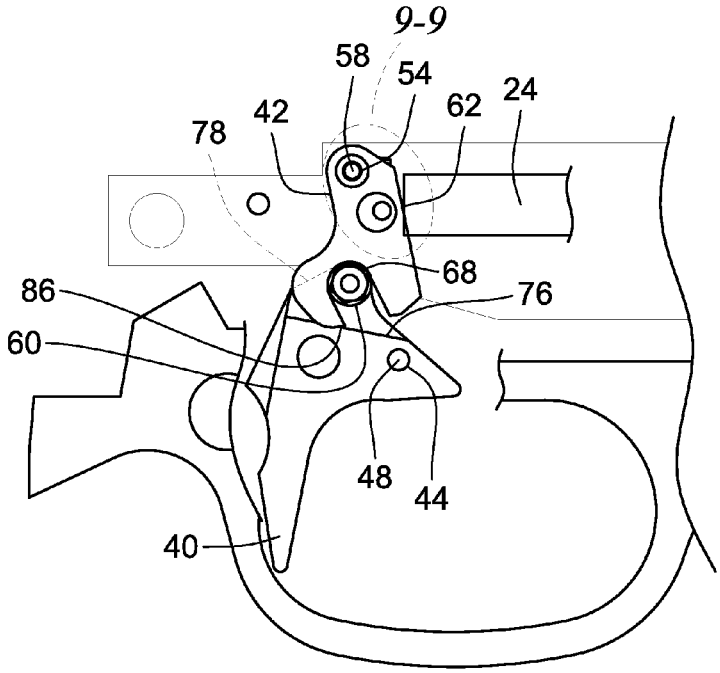
Figure 9:
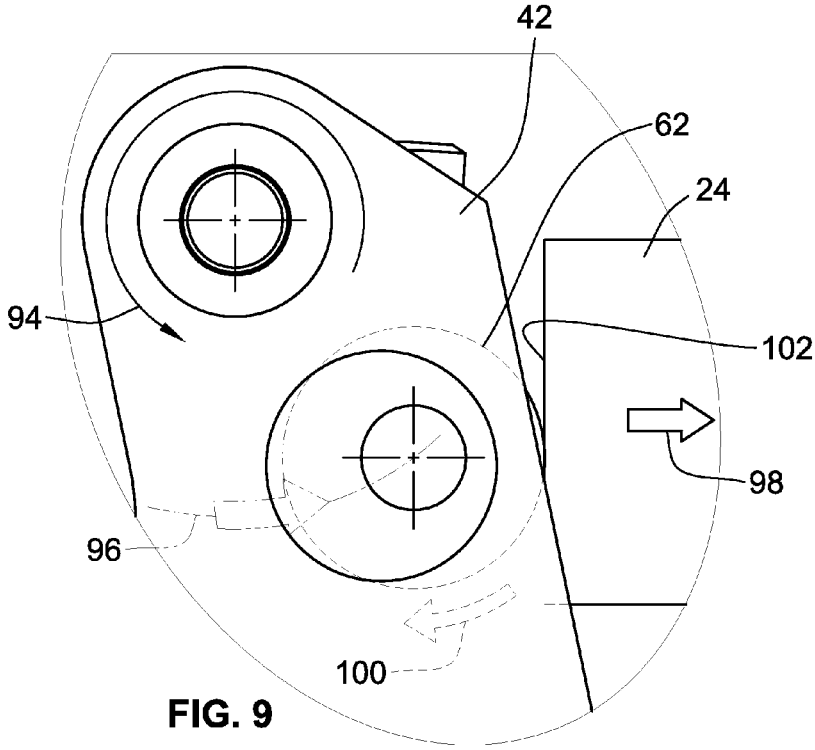

Turning now to FIG. 8, trigger assembly 22 is shown at the limit of its range of motion wherein actuation element 24 is in contact with second rolling contact element 62 to thereby cause firing mechanism 20 (See FIG. 1) to complete the firing of a firearm incorporating firing mechanism 20. As can be seen in this illustration, second rolling contact element 62 is in surface contact with actuation element 24. Additionally, first abutment surface 76 is in abutted contacted with third abutment surface 86. Second abutment surface 78 is in abutted contacted with fourth abutment surface 88. The abutment of these surfaces limits further rotation of first trigger element 40 about axis 48 in rotational direction 92. Likewise, the abutment of the aforementioned abutment surfaces also limits further rotation of second trigger element 42 about axis 58 and rotational direction 94. Although not illustrated, trigger guard 28 can also incorporate a spring loaded plunger in proximity to a backside of first trigger element 40 to provide a degree of tactile resistance as first trigger element 40 approaches its limit of travel.

With reference to FIG. 8, as second rolling contact element 62 is brought into contact with contact surface 102 of actuation element 24 by moving along arcuate path 96, second rolling contact element 62 will rotate about its center axis along rotational direction 100 while causing actuation element 24 to move in linear direction 98 to ultimately complete the firing sequence of firing mechanism 20.

From the foregoing, those skilled in the art will recognize that the incorporation of multiple trigger elements as well as rolling contact elements substantially reduces the trigger pull of existing trigger assemblies by minimizing friction and reducing internal mechanical torque between elements. Indeed, utilization of the illustrated trigger assembly has been shown to provide an 85% trigger pull force reduction over certain existing trigger assemblies, and/or a leverage ratio of approximately 1:5 over current ratios of approximately 1:1. As a result, the trigger assembly described herein provides significant improvement in precision and accuracy for recreational and operational shooters alike.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A firearm trigger assembly, comprising:

a first trigger element pivotably mounted at a first pivot point;

a second trigger element pivotably mounted at a second pivot point, the second pivot point in spaced relation to the first pivot point;

wherein a portion of the first trigger element is received in a recess of the second trigger element such that rotation of the first trigger element about the first pivot point causes a rotation of the second trigger element about the second pivot point;

wherein a yoke and tongue arrangement is formed between the first and second trigger elements such that the second trigger element includes a yoke portion that defines the recess thereof, and such that the first trigger element includes a tongue portion that is said portion that is received in the recess of the second trigger element;

wherein the recess defines an interior contact surface for contact with the first trigger element; and wherein a first rolling contact element is rotationally mounted on the tongue portion and positioned within the recess of the second trigger element, the first rolling contact element in contact with the interior contact surface of the recess.

2. The trigger assembly of claim 1, wherein a second rolling contact element is rotationally mounted on the second trigger element and arranged to intermittently contact an actuation element of a firing mechanism incorporating the trigger assembly.

3. The trigger assembly of claim 2, wherein the first and second rolling contact elements are roller bearings.

4. The trigger assembly of claim 1, wherein first and second pivot points are in spaced relation such that rotation of the first trigger element about the first pivot point in a first rotational direction causes the second trigger element to rotate about the second pivot point in a second rotational direction opposite the first rotational direction.

5. The firearm trigger assembly of claim 1, wherein the first rolling contact element moves linearly within the recess relative to the contact surface upon rotation of the first trigger element about a first pivot point that the first trigger element is pivotably mounted at.

6. The firearm trigger assembly of claim 5, wherein the first rolling contact element rotates about its center axis while moving linearly within the recess relative to the contact surface.

7. The firearm trigger assembly of claim 1, wherein the first trigger element defines at least one abutment surface, and the second trigger element defines at least one abutment surface, wherein the at least one abutment surface of the first trigger element and the at least one abutment surface of the second trigger element are arranged to abut one another to limit relative motion of the first trigger element relative to the second trigger element.

8. The firearm trigger assembly of claim 7, wherein the at least one abutment surface of the first trigger element includes first and second abutment surfaces, and wherein the at least one abutment surface of the second trigger element includes third and fourth abutment surfaces.

9. The firearm trigger assembly of claim 8, wherein the first and second abutment surfaces simultaneously contact the third and fourth abutment surfaces to limit relative motion of the first trigger element relative to the second trigger element.

* * * * *